US011309116B2

(12) United States Patent
Matsuura et al.

(10) Patent No.: US 11,309,116 B2
(45) Date of Patent: Apr. 19, 2022

(54) ELECTRONIC COMPONENT

(71) Applicant: Murata Manufacturing Co., Ltd., Kyoto-fu (JP)

(72) Inventors: Kouhei Matsuura, Nagaokakyo (JP); Morihiro Hamano, Nagaokakyo (JP); Keiichi Tsuduki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 768 days.

(21) Appl. No.: 16/201,971

(22) Filed: Nov. 27, 2018

(65) Prior Publication Data

US 2019/0164677 A1 May 30, 2019

(30) Foreign Application Priority Data

Nov. 29, 2017 (JP) ..... JP2017-229449
Aug. 10, 2018 (JP) ..... JP2018-152033

(51) Int. Cl.
*H01F 5/00* (2006.01)
*H01F 17/00* (2006.01)
(Continued)

(52) U.S. Cl.
CPC ..... *H01F 17/0013* (2013.01); *H01F 17/0033* (2013.01); *H01F 27/2804* (2013.01);
(Continued)

(58) Field of Classification Search
CPC ..... H01F 27/2804; H01F 17/0013; H01F 27/292; H01F 2017/0093
(Continued)

(56) References Cited

U.S. PATENT DOCUMENTS 7,362,205 B2 * 4/2008 Ito ..... H01F 17/0013 336/200
8,525,039 B2 * 9/2013 Nishino ..... C03C 8/02 174/257
(Continued)

FOREIGN PATENT DOCUMENTS

CN 1858864 A 11/2006
CN 103964824 A 8/2014
(Continued)

OTHER PUBLICATIONS

An Office Action mailed by the China National Intellectual Property Administration dated Jun. 30, 2020, which corresponds to Chinese Patent Application No. 201811443701.7 and is related to U.S. Appl. No. 16/201,971 with English language translation.

*Primary Examiner* — Alexander Talpalatski
*Assistant Examiner* — Joselito S. Baisa
(74) *Attorney, Agent, or Firm* — Studebaker & Brackett PC

(57) ABSTRACT

An electronic component with a plurality of coil conductor layers laminated such that a coil conductor having a coil pattern on a surface of an insulation layer is formed on each of the plurality of coil conductor layers. The electronic component includes a laminated body in which a bottom face side extended electrode layer, a primary coil conductor layer including a primary coil conductor, a secondary coil conductor layer including a secondary coil conductor, a tertiary coil conductor layer including a tertiary coil conductor, a parallel primary coil conductor layer including a parallel primary coil conductor, and a top face side extended electrode layer are laminated in this order. The electronic component further includes first through sixth external electrodes on a surface of the laminated body, which are
(Continued)

connected to the primary, secondary, tertiary and parallel primary coil conductors.

20 Claims, 13 Drawing Sheets

(51) Int. Cl.
*H01F 27/29* (2006.01)
*H01F 41/02* (2006.01)
*H01F 27/28* (2006.01)
*H01F 41/04* (2006.01)

(52) U.S. Cl.
CPC ..... *H01F 27/292* (2013.01); *H01F 41/0233* (2013.01); *H01F 41/046* (2013.01); *H01F 2017/0066* (2013.01); *H01F 2017/0093* (2013.01)

(58) Field of Classification Search
USPC ..... 336/200
See application file for complete search history.

(56) References Cited

U.S. PATENT DOCUMENTS

| | | | | |
|---|---|---|---|---|
| 10,176,927 | B2 * | 1/2019 | Matsunaga | H01G 4/005 |
| 10,636,561 | B2 * | 4/2020 | Harada | H01F 17/0013 |
| 2005/0068148 | A1 * | 3/2005 | Yoshida | H01F 17/0013 336/200 |
| 2009/0003191 | A1 * | 1/2009 | Inuzuka | H01F 17/0013 369/283 |
| 2009/0283306 | A1 * | 11/2009 | Nishino | C03C 8/04 174/257 |
| 2013/0015935 | A1 * | 1/2013 | Chang | H01F 17/0013 336/200 |
| 2014/0220364 | A1 | 8/2014 | Umemoto et al. | |
| 2016/0049234 | A1 * | 2/2016 | Kawashima | H01F 17/0013 336/200 |
| 2017/0125154 | A1 | 5/2017 | Karino et al. | |

FOREIGN PATENT DOCUMENTS

| | | | |
|---|---|---|---|
| CN | 107039160 | A | 8/2017 |
| JP | 2000-030945 | A | 1/2000 |
| WO | 2013/69485 | A1 | 5/2013 |

* cited by examiner

ELECTRONIC COMPONENT

CROSS-REFERENCE TO RELATED APPLICATIONS

This application claims benefit of priority to Japanese Patent Application No. 2017-229449, filed Nov. 29, 2017, and to Japanese Patent Application No. 2018-152033, filed Aug. 10, 2018, the entire content of each are incorporated herein by reference.

BACKGROUND

Technical Field

The present disclosure relates to an electronic component.

Background Art

Conventionally, mobile industry processor interface (MIPI) D-PHY standard has been applied as a digital data transfer standard for connecting a main IC with a display and a camera in a mobile device, and a method is used in which transmission is performed with differential signals using two transmission lines. When such differential signals are transmitted, common mode noise is generated, so that a filter (common mode filter) for removing the noise is used.

In recent years, as the number of images of cameras increases and the frame frequency increases, further increase in data transfer rate is required. As a standard corresponding to such a high data transfer rate, there is MIPI-C-PHY standard which improves the data transfer rate by increasing the number of transmission lines to three.

Even in the case of three transmission lines, common mode noise occurs as in the case of two transmission lines, so that a common mode filter (also called common mode noise filter) corresponding to three transmission lines is used. In the common mode noise filter corresponding to three transmission lines, for example, first to fourth coils are disposed via an insulation layer so as to overlap each other in a top view as described, for example, in PCT International Publication No. 2013/69485.

SUMMARY

In the common mode noise filter described in PCT International Publication No. 2013/69485, in order to connect the outside and the inside of each coil, vias are formed inside the coil, and the electrode is extended from a layer different from a layer in which the coil is formed through the via. Therefore, in the common mode noise filter described in PCT International Publication No. 2013/69485, at least three vias are provided inside the coil. However, there is the problem that it is difficult to improve the impedance characteristics by increasing the number of windings of the coil, disposing an iron core or the like inside the coil, or the like since the three vias occupy the space inside the coil.

The present disclosure thus provides an electronic component capable of improving impedance characteristics. An electronic component according to the present disclosure is an electronic component with a plurality of coil conductor layers laminated wherein a coil conductor having a coil pattern on a surface of an insulation layer is formed on each of the plurality of coil conductor layers. The electronic component includes a laminated body in which a bottom face side extended electrode layer, a primary coil conductor layer including a primary coil conductor, a secondary coil conductor layer including a secondary coil conductor, a tertiary coil conductor layer including a tertiary coil conductor, a parallel primary coil conductor layer including a parallel primary coil conductor, and a top face side extended electrode layer are laminated in this order. The electronic component further includes a first external electrode; a second external electrode; a third external electrode; a fourth external electrode; a fifth external electrode; and a sixth external electrode. All of the external electrodes are provided on a surface of the laminated body. The primary coil conductor is connected to the first external electrode and the fourth external electrode. The secondary coil conductor is connected to the second external electrode and the fifth external electrode. The tertiary coil conductor is connected to the third external electrode and the sixth external electrode. The parallel primary coil conductor is connected to the first external electrode and the fourth external electrode. The primary coil conductor and the parallel primary coil conductor are connected in parallel. Each of the primary coil conductor, the secondary coil conductor, the tertiary coil conductor, and the parallel primary coil conductor has a coil pattern, an inner end which is one end of the coil pattern and is disposed inside the coil pattern, and an outer end which is the other end of the coil pattern and is disposed outside the coil pattern. The inner end of the primary coil conductor and the inner end of the secondary coil conductor are connected to the bottom face side extended electrode layer through a first via hole conductor and a second via hole conductor both of which are provided inside the coil pattern, respectively. The inner end of the tertiary coil conductor and the inner end of the parallel primary coil conductor are connected to the top face side extended electrode layer through a third via hole conductor and a fourth via hole conductor both of which are provided inside the coil pattern, respectively. In a top view of the laminated body, the first via hole conductor and the second via hole conductor are disposed at a position where at least part of the first via hole conductor and at least part of the second via hole conductor overlap any one of the third via hole conductor and the fourth via hole conductor, and wherein a number of via hole conductors provided inside the coil pattern is two at a maximum in each of all coil conductor layers constituting the laminated body.

In the electronic component according to the present disclosure, it is preferable that the first external electrode, the second external electrode, and the third external electrode be provided on a first end face of the laminated body, the fourth external electrode, the fifth external electrode, and the sixth external electrode be provided on a second end face facing the first end face. It is also preferable that the first external electrode, the second external electrode, and the third external electrode be disposed at positions facing the fourth external electrode, the fifth external electrode, and the sixth external electrode, respectively. It is further preferable that the first external electrode be disposed between the second external electrode and the third external electrode, and the fourth external electrode be disposed between the fifth external electrode and the sixth external electrode.

In the electronic component according to the present disclosure, it is preferable that an inner magnetic path penetrating the primary coil conductor layer, the secondary coil conductor layer, the tertiary coil conductor layer, and the parallel primary coil conductor layer be provided at a position inside of a coil pattern in each of the primary coil conductor layer, the secondary coil conductor layer, the tertiary coil conductor layer, and the parallel primary coil conductor layer, with the position overlapping none of the first via hole conductor, the second via hole conductor, the third via hole conductor, and the fourth via hole conductor in a top view of the laminated body.

In the electronic component according to the present disclosure, it is preferable that the secondary coil conductor layer include a plurality of secondary coil conductors having coil patterns substantially overlapping each other in the top view of the laminated body. In the electronic component according to the present disclosure, it is preferable that the tertiary coil conductor layer include a plurality of tertiary coil conductors having coil patterns substantially overlapping each other in the top view of the laminated body.

In the electronic component according to the present disclosure, it is preferable that a bottom face side magnetic layer and a top face side magnetic layer which are magnetic layers containing at least ferrite be further provided on a bottom of the bottom face side extended electrode layer, and a top of the top face side extended electrode layer, respectively. In the electronic component according to the present disclosure, it is preferable that a bottom face side insulator layer and a top face side insulator layer which are insulator layers containing at least glass ceramic be further provided on a bottom of the bottom face side magnetic layer and a top of the top face side magnetic layer.

In the electronic component according to the present disclosure, it is preferable that a number of windings of a coil pattern in each of the primary coil conductor layer, the secondary coil conductor layer, the tertiary coil conductor layer, and the parallel primary coil conductor layer be four or more. In the electronic component according to the present disclosure, it is preferable that a pitch of a coil pattern in each of the primary coil conductor layer, the secondary coil conductor layer, the tertiary coil conductor layer, and the parallel primary coil conductor layer be 28 μm or more and 34 μm or less (i.e., from 28 μm to 34 μm).

In the electronic component according to the present disclosure, it is preferable that the laminated body have an outer dimension of 0.80 mm or more and 1.00 mm or less (i.e., from 0.80 mm to 1.00 mm) in length, 0.58 mm or more and 0.78 mm or less (i.e., from 0.58 mm to 0.78 mm) in width, and 0.25 mm or more and 0.45 mm or less (i.e., from 0.25 mm to 0.45 mm) in height.

According to the present disclosure, it is possible to provide an electronic component capable of improving impedance characteristics.

DETAILED DESCRIPTION

Figure 1:
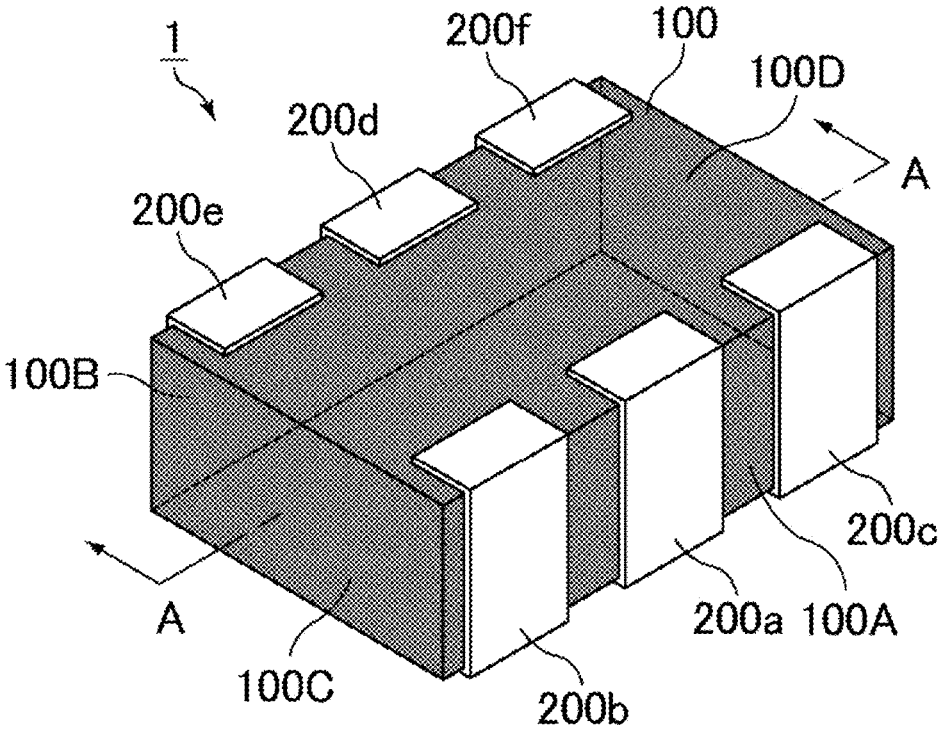
FIG. 1 is a perspective view schematically showing an example of an electronic component according to the present disclosure.

Hereinafter, an electronic component according to the present disclosure will be described.

The present disclosure is not limited to the following configurations, but can be applied by appropriately changing the configurations within a range not changing the gist of the present disclosure. Note that a combination of two or more individual preferable configurations according to the present disclosure described below is also the present disclosure.

[Electronic Component]

First, an electronic component according to the present disclosure will be described.

An electronic component according to the present disclosure is an electronic component with a plurality of coil conductor layers laminated wherein a coil conductor having a coil pattern on a surface of an insulation layer is formed on each of the plurality of coil conductor layers. The electronic component includes a laminated body in which a bottom face side extended electrode layer, a primary coil conductor layer including a primary coil conductor, a secondary coil conductor layer including a secondary coil conductor, a tertiary coil conductor layer including a tertiary coil conductor, a parallel primary coil conductor layer including a parallel primary coil conductor, and a top face side extended electrode layer are laminated in this order. The electronic component further includes a first external electrode; a second external electrode; a third external electrode; a fourth external electrode; a fifth external electrode; and a sixth external electrode, wherein all of the external electrodes are provided on a surface of the laminated body. The primary coil conductor is connected to the first external electrode and the fourth external electrode. The secondary coil conductor is connected to the second external electrode and the fifth external electrode. The tertiary coil conductor is connected to the third external electrode and the sixth external electrode. The parallel primary coil conductor is connected to the first external electrode and the fourth external electrode. The primary coil conductor and the parallel primary coil conductor are connected in parallel. Each of the primary coil conductor, the secondary coil conductor, the tertiary coil conductor, and the parallel primary coil conductor has a coil pattern, an inner end which is one end of the coil pattern and is disposed inside the coil pattern, and an outer end which is the other end of the coil pattern and is disposed outside the coil pattern. The inner end of the primary coil conductor and the inner end of the secondary coil conductor are connected to the bottom face side extended electrode layer through a first via hole conductor and a second via hole conductor both of which are provided inside the coil pattern, respectively. The inner end of the tertiary coil conductor and the inner end of the parallel primary coil conductor are connected to the top face side extended electrode layer through a third via hole conductor and a fourth via hole conductor both of which are provided inside the coil pattern, respectively. In a top view of the laminated body, the first via hole conductor and the second via hole conductor are disposed at a position where at least part of the first via hole conductor and at least part of the second via hole conductor overlap any one of the third via hole conductor and the fourth via hole conductor. A number of via hole conductors provided inside the coil pattern is two at a maximum in each of all coil conductor layers constituting the laminated body.

External electrodes constituting an electronic component according to the present disclosure will be described.

An electronic component according to the present disclosure includes on a surface of a laminated body a first external electrode, a second external electrode, a third external electrode, a fourth external electrode, a fifth external electrode, and a sixth external electrode (hereinafter collectively referred to as first to sixth external electrodes).

Although the arrangement of the first to sixth external electrodes on the surface of the laminated body is not particularly limited, it is preferable that, considering that a primary coil conductor is connected to the first external electrode and the fourth external electrode, a secondary coil conductor is connected to the second external electrode and the fifth external electrode, and a tertiary coil conductor is connected to the third external electrode and the sixth external electrode, the first external electrode and the fourth external electrode be disposed to face each other, the second external electrode and the fifth external electrode be disposed to face each other, and the third external electrode and the sixth external electrode be disposed to face each other.

In addition, it is preferable that the first external electrode, the second external electrode, and the third external electrode be provided on a first end face of the laminated body, and the fourth external electrode, the fifth external electrode, and the sixth external electrode be provided on a second end face facing the first end face. Further, it is preferable that at the first end face, the first external electrode be disposed between the second external electrode and the third external electrode, and at the second end face, the fourth external electrode be disposed between the fifth external electrode and the sixth external electrode.

In a case where the cross-sectional areas of the coil conductors constituting the respective coil conductor layers are substantially the same, the first external electrode and the fourth external electrode, which are connected to the primary coil conductor layer and the parallel primary coil conductor layer, constitute a series resistance ($R_{DC}$) different from that constituted by the secondary coil conductor layer and the tertiary coil conductor layer. At this time, when the first external electrode and the fourth external electrode connected to a primary coil and a parallel primary coil are disposed between the second external electrode and the third external electrode, and between the fifth external electrode and the sixth external electrode respectively, polarity does not occur at the position of the external electrode, so that it is possible to use the electronic component without the distinction of the left and right of the electronic component.

External electrodes will be described with reference to FIG. 1.

FIG. 1 is a perspective view schematically showing an example of an electronic component according to the present disclosure.

As shown in FIG. 1, an electronic component 1 includes on an end face of a laminated body 100 a first external electrode 200*a*, a second external electrode 200*b*, a third external electrode 200*c*, a fourth external electrode 200*d*, a fifth external electrode 200*e*, and a sixth external electrode 200*f*. The first external electrode 200*a*, the second external electrode 200*b*, and the third external electrode 200*c* are provided on a first end face 100A, and the fourth external electrode 200*d*, the fifth external electrode 200*e*, and the sixth external electrode 200*f* are provided on a second end face 100B facing the first end face 100A.

The first external electrode 200*a* is disposed between the second external electrode 200*b* and the third external electrode 200*c*, and the fourth external electrode 200*d* is disposed between the fifth external electrode 200*e* and the sixth external electrode 200*f*. In the electronic component 1 shown in FIG. 1, the first to sixth external electrodes 200*a* to 200*f* are also formed on part of a bottom face 100C and a top face 100D of the laminated body 100. However, the bottom face 100C and the top face 100D of the laminated body 100 may not have external electrodes formed thereon.

A Laminated body constituting an electronic component according to the present disclosure will be described. A laminated body includes a bottom face side extended electrode layer, a primary coil conductor layer including a primary coil conductor, a secondary coil conductor layer including a secondary coil conductor, a tertiary coil conductor layer including a tertiary coil conductor, a parallel primary coil conductor layer including a parallel primary coil conductor, and a top face side extended electrode layer in this order.

In the electronic component according to the present disclosure, the laminated body may further include an insulator layer. It is preferable that the insulator layer be formed on the bottom face of the bottom face side extended electrode layer and/or the top face of the top face side extended electrode layer.

The configuration of the laminated body will be described with reference to FIGS. 2 and 3.

Figure 2:
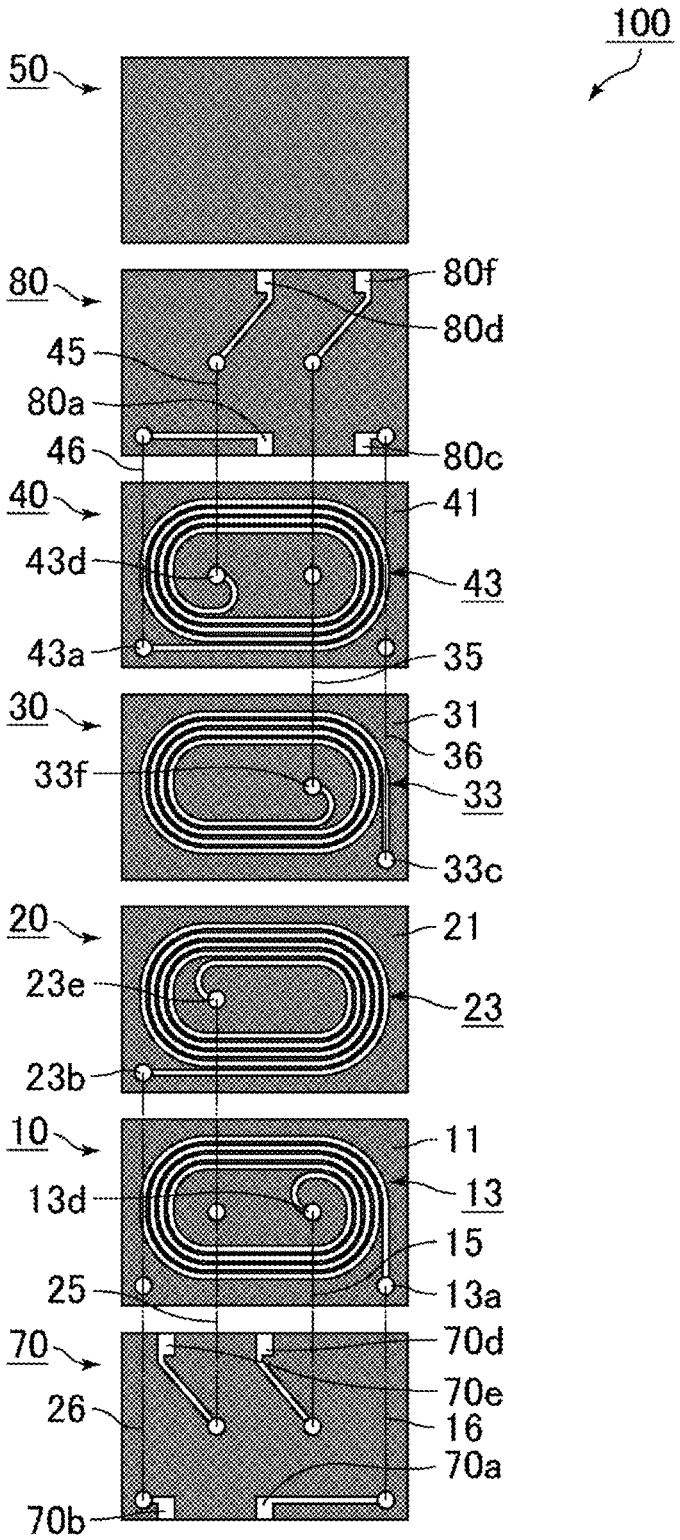
FIG. 2 is an explanatory view schematically showing a state in which a laminated body constituting the electronic component according to the present disclosure is separated and arranged for each layer.

FIG. 2 is an explanatory view schematically showing a state in which the laminated body constituting the electronic component according to the present disclosure is separated and arranged for each layer. FIG. 3 is a cross-sectional view schematically showing a state in which the laminated body shown in FIG. 2 is cut at a position same as line A-A in FIG. 1.

As shown in FIG. 2, the laminated body 100 includes, in order from the bottom face, a bottom face side extended electrode layer 70, a primary coil conductor layer 10, a secondary coil conductor layer 20, a tertiary coil conductor layer 30, a parallel primary coil conductor layer 40, a top face side extended electrode layer 80, and an insulator layer 50. Extended electrodes 70*a*, 70*b*, 70*d*, 70*e*, 80*a*, 80*c*, 80*d*, 80*f*, which are exposed on the end face of the laminated body 100 and connected to an external electrode are provided on the bottom face side extended electrode layer 70 and the top face side extended electrode layer 80. The insulator layer 50 is not provided with a coil conductor or an extended electrode.

In FIG. 2, via hole conductors connecting each layer constituting the laminated body are denoted by two-dot chain lines.

The extended electrode 70*a* is connected to the first external electrode 200*a* shown in FIG. 1. The extended electrode 70*b* is connected to the second external electrode 200*b* shown in FIG. 1. The extended electrode 70*d* is connected to the fourth external electrode 200*d* shown in FIG. 1.

The extended electrode 70*e* is connected to the fifth external electrode 200*e* shown in FIG. 1. The extended electrode 80*a* is connected to the first external electrode 200*a* shown in FIG. 1. The extended electrode 80*c* is connected to the third external electrode 200*c* shown in FIG. 1. The extended electrode 80*d* is connected to the fourth external electrode 200*d* shown in FIG. 1. The extended electrode 80*f* is connected to the sixth external electrode 200*f* shown in FIG. 1.

In the laminated body 100, the primary coil conductor layer 10, the secondary coil conductor layer 20, the tertiary coil conductor layer 30 and the parallel primary coil conductor layer 40 are not provided with an extended electrode, which is exposed to the end face of the laminated body 100 and connected to the external electrode. The primary coil conductor layer 10 includes a primary coil conductor 13, which is a coil pattern on the surface of an insulation layer 11. One end of the primary coil conductor 13 is an outer end 13*a* existing outside the coil pattern and the other end is an inner end 13*d* existing inside the coil pattern.

The secondary coil conductor layer 20 includes a secondary coil conductor 23, which is a coil pattern on the surface of an insulation layer 21. One end of the secondary coil conductor 23 is an outer end 23*b* existing outside the coil pattern and the other end is an inner end 23*e* existing inside the coil pattern. The tertiary coil conductor layer 30 includes a tertiary coil conductor 33, which is a coil pattern on the surface of an insulation layer 31. One end of the tertiary coil conductor 33 is an outer end 33*c* existing outside the coil pattern and the other end is an inner end 33*f* existing inside the coil pattern.

The parallel primary coil conductor layer 40 includes a parallel primary coil conductor 43, which is a coil pattern on the surface of an insulation layer 41. One end of the parallel primary coil conductor 43 is an outer end 43*a* existing outside the coil pattern and the other end is an inner end 43*d* existing inside the coil pattern.

Figure 3:
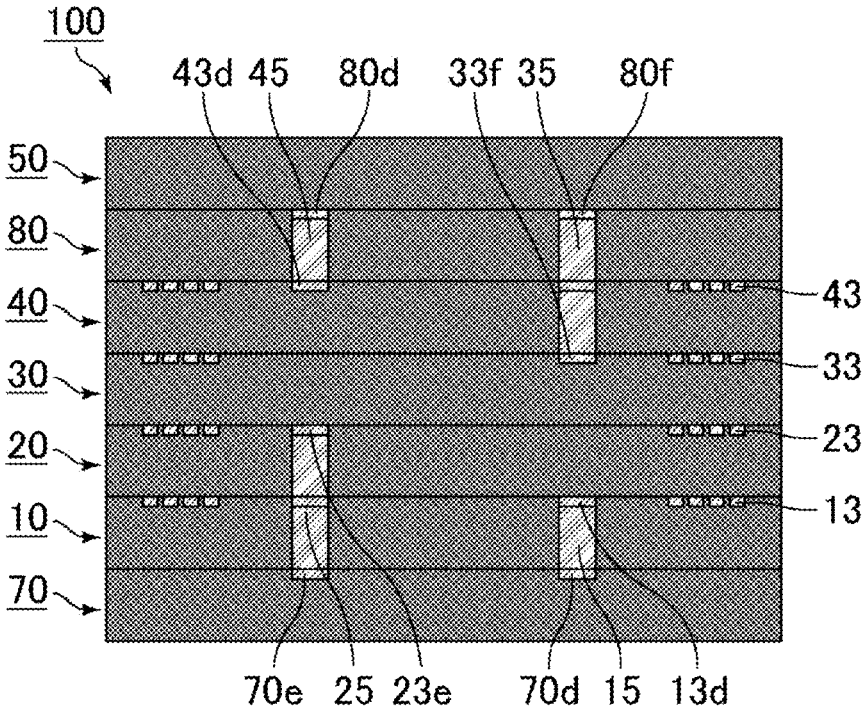
FIG. 3 is a cross-sectional view schematically showing a state in which the laminated body shown in FIG. 2 is cut at a position same as line A-A in FIG. 1.

As shown in FIG. 3, the primary coil conductor 13 constituting the primary coil conductor layer 10 is connected to the bottom face side extended electrode layer 70 through a first via hole conductor 15. Specifically, the inner end 13*d* of the primary coil conductor 13 provided on the primary coil conductor layer 10 and the extended electrode 70*d* provided on the bottom face side extended electrode layer 70 are connected to each other through the first via hole conductor 15 provided inside the coil pattern. As shown in FIG. 2, the outer end 13*a* of the primary coil conductor 13 is connected to the extended electrode 70*a* provided on the bottom face side extended electrode layer 70 through a via hole conductor 16.

The secondary coil conductor 23 constituting the secondary coil conductor layer 20 is connected to the bottom face side extended electrode layer 70 through a second via hole conductor 25. Specifically, the inner end 23*e* of the secondary coil conductor 23 provided on the secondary coil conductor layer 20 and the extended electrode 70*e* provided on the bottom face side extended electrode layer 70 are connected to each other through the second via hole conductor 25 provided inside the coil pattern. As shown in FIG. 2, the outer end 23*b* of the secondary coil conductor 23 is connected to the extended electrode 70*b* provided on the bottom face side extended electrode layer 70 through a via hole conductor 26.

The tertiary coil conductor 33 constituting the tertiary coil conductor layer 30 is connected to the top face side extended electrode layer 80 through a third via hole conductor 35. Specifically, the inner end 33*f* of the tertiary coil conductor 33 provided on the tertiary coil conductor layer 30 and the extended electrode 80*f* provided on the top face side extended electrode layer 80 are connected to each other through the third via hole conductor 35 provided inside the coil pattern. As shown in FIG. 2, the outer end 33*c* of the tertiary coil conductor 33 is connected to the extended electrode 80*c* provided on the top face side extended electrode layer 80 through a via hole conductor 36.

The parallel primary coil conductor 43 constituting the parallel primary coil conductor layer 40 is connected to the top face side extended electrode layer 80 through a fourth via hole conductor 45. Specifically, the inner end 43*d* of the parallel primary coil conductor 43 provided on the parallel primary coil conductor layer 40 and the extended electrode 80*d* provided on the top face side extended electrode layer 80 are connected to each other through the fourth via hole conductor 45 provided inside the coil pattern. As shown in FIG. 2, the outer end 43*a* of the parallel primary coil conductor 43 is connected to the extended electrode 80*a* provided on the top face side extended electrode layer 80 through a via hole conductor 46.

As shown in FIGS. 2 and 3, in a top view of the laminated body 100, the first via hole conductor 15 and the third via hole conductor 35 are disposed at an overlapping position, and the second via hole conductor 25 and the fourth via hole conductor 45 are disposed at an overlapping position. As a result, the number of the via hole conductors provided inside the coil pattern is two at a maximum in all coil conductor layers constituting the laminated body 100.

In the laminated body 100 shown in FIGS. 2 and 3, the first via hole conductor 15 and the third via hole conductor 35 completely overlap each other in a top view of the laminated body 100, and the second via hole conductor 25 and the fourth via hole conductor 45 completely overlap each other in a top view of the laminated body 100. However, the first via hole conductor 15 and the third via hole conductor 35 may overlap at least partially in a top view of the laminated body 100, and the second via hole conductor 25 and the fourth via hole conductor 45 may overlap at least partially in a top view of the laminated body 100.

In the electronic component according to the present disclosure, the number of the via hole conductors provided inside the coil pattern is two at a maximum in all coil conductor layers constituting the laminated body, so that the area inside the coil pattern can be used for an application other than providing a third via hole conductor. Examples of the application other than providing the third via hole conductor include increasing the number of windings of the coil pattern, and providing an inner magnetic path, and the like. By increasing the number of windings of the coil pattern or by providing an inner magnetic path, the impedance characteristics of the electronic component can be improved.

Although the outer dimension of the laminated body is not particularly limited, it is preferable that the length be 0.80 mm or more and 1.00 mm or less (i.e., from 0.80 mm to 1.00 mm), the width be 0.58 mm or more and 0.78 mm or less (i.e., from 0.58 mm to 0.78 mm), and the height be 0.25 mm or more and 0.45 mm or less (i.e., from 0.25 mm or more and 0.45 mm).

The corner portion and the ridgeline portion of the laminated body may be rounded. When the corner portion or the ridgeline portion of the laminated body is rounded, the outer dimension shall be measured assuming that it is not rounded.

In the laminated body, in addition to the bottom face side extended electrode layer, the primary coil conductor layer, the secondary coil conductor layer, the tertiary coil conductor layer, the parallel primary coil conductor layer and the top face side extended electrode layer, an extended electrode layer for drawing a current from the coil conductor layer may be separately provided between the primary coil conductor layer and the secondary coil conductor layer, between the secondary coil conductor layer and the tertiary coil conductor layer, and between the tertiary coil conductor layer and the parallel primary coil conductor layer.

However, when the extended electrode layer is disposed between the coil conductor layers, the characteristic impedance changes due to the change in the distance between the coil conductors, so that it is difficult to match the characteristic impedance between the primary coil conductor layer, the secondary coil conductor layer, the tertiary coil conductor layer and the parallel primary coil conductor layer. Therefore, in the laminated body constituting the electronic component according to the present disclosure, it is preferable not to dispose an extended electrode layer between the primary coil conductor layer, the secondary coil conductor layer, the tertiary coil conductor layer and the parallel primary coil conductor layer.

In the electronic component according to the present disclosure, the material constituting the insulation layer constituting the coil conductor layer is preferably a non-magnetic material such as a glass ceramic material, or a mixed material obtained by mixing a non-magnetic material and a magnetic material such as a ferrite material. As the glass ceramic material, it is preferable to use borosilicate glass containing Si and B as a main components.

As a composition of the borosilicate glass, for example, $SiO_2$ is 70 wt % or more and 85 wt % or less (i.e., from 70 wt % to 85 wt %), $B_2O_3$ is 10 wt % or more and 25 wt % or less (i.e., from 10 wt % to 25 wt %), $K_2O$ is 0.5 wt % or more and 5 wt % or less (i.e., from 0.5 wt % to 5 wt %), and $Al_2O_3$ is 0 wt % or more and 5 wt % or less (i.e., from 0 wt % to 5 wt %).

Since borosilicate glass has a low relative permittivity, high frequency characteristics of electronic components can be improved.

An example of the ferrite material includes Ni—Zn—Cu ferrite.

Since ferrite has a high relative permeability, it is easy to improve impedance characteristics. However, when a single ferrite material is used as a material constituting the insulation layer, the relative permittivity of the insulation layer is too high, so that the high frequency characteristics may be deteriorated in some cases. Therefore, it is preferable that the ferrite material be used as a material constituting the insulation layer by mixing the ferrite material with the non-magnetic material.

In addition to the ferrite material and/or the glass ceramic material, a filler component such as quartz ($SiO_2$), forsterite ($2MgO.SiO_2$), alumina ($Al_2O_3$) or the like is added to the insulation layer in an amount of preferably 2 wt % or more and 41 wt % or less (i.e., from 2 wt % to 41 wt %), more preferably 20 wt % or more and 41 wt % or less (i.e., from 20 wt % to 41 wt %) of the weight of the entire insulation layer.

Since quartz has a relative permittivity lower than that of borosilicate glass, the high frequency characteristics of electronic components can be further improved. Since forsterite and alumina have high transverse rupture strength, the mechanical strength of electronic components can be improved. As the composition of the insulation layer when the filler is added, for example, $SiO_2$ is 76.0 wt % or more and 90.0 wt % or less (i.e., from 76.0 wt % to 90.0 wt %), $B_2O_3$ is 7 wt % or more and 21.8 wt % or less (i.e., from 7 wt % to 21.8 wt %), $K_2O$ is 0.5 wt % or more and 5 wt % or less (i.e., from 0.5 wt % to 5 wt %), and $Al_2O_3$ is 1.7 wt % or more and 6.0 wt % or less (i.e., from 1.7 wt % to 6.0 wt %).

In the electronic component according to the present disclosure, the coil conductor constituting the coil conductor layer has a coil pattern, an outer end disposed outside the coil pattern, and an inner end disposed inside the coil pattern. The coil conductor can be formed by disposing a conductive paste on the insulation layer by a method such as printing. The material constituting the coil conductor is not particularly limited, but may include Ag or the like.

The number of turns (also referred to as the number of windings) of each coil conductor is not particularly limited, and the number of windings may be set according to desired frequency characteristics, but the number of turns is preferably 4 to 10, both inclusive, more preferably 6 to 10, both inclusive. The conductor length (the wiring length of the coil pattern portion) of each coil conductor is not particularly limited, but it is preferable that the length be substantially the same in all the coil conductors.

The cross-sectional area (the product of the line width and the thickness of the coil conductor pattern) of each coil conductor is not particularly limited, but from the viewpoint of equalizing a series resistance of each coil conductor layer, it is preferable that cross-sectional areas of the secondary coil conductor and the tertiary coil conductor be made substantially the same, and the cross-sectional areas of the primary coil conductor and the parallel primary coil conductor be 0.5 times the cross-sectional areas of the secondary coil conductor and the tertiary coil conductor. The cross-sectional areas of the primary coil conductor and the parallel primary coil conductor are 0.5 times the cross-sectional areas of the secondary coil conductor and the tertiary coil conductor, so that a series resistance between the first external electrode and the fourth external electrode, a series resistance between the second external electrode and the fifth external electrode, and a series resistance between the third external electrode and the sixth external electrode can be adjusted to be substantially the same.

The pitch of the coil pattern in each coil conductor (the sum of the line width of the coil conductor pattern and the distance to the adjacent coil conductor pattern) is not particularly limited, but it is preferably 28 μm or more and 34 μm or less (i.e., from 28 μm to 34 μm). The line width of the coil pattern in each coil conductor is preferably 13 μm or more and 17 μm or less (i.e., from 13 μm to 17 μm), and more preferably 15 μm. The distance between the coil patterns in each coil conductor is preferably 14 μm or more and 18 μm or less (i.e., from 14 μm to 18 μm), and more preferably 16 μm. The cross-sectional area of the coil conductor is preferably 30 $\mu m^2$ or more and 160 $\mu m^2$ or less (i.e., from 30 $\mu m^2$ to 160 $\mu m^2$).

When the cross-sectional area of the coil conductor is less than 30 $\mu m^2$, it is difficult to form the coil conductor layer by a method such as screen-printing, and a wiring defect (disconnection) is likely to occur. On the other hand, when the cross-sectional area of the coil conductor exceeds 160 μm', it is necessary to reduce the number of windings of the coil pattern so that the distance between the coil patterns is not too close, and desired impedance characteristics may not be obtained in some cases.

In the electronic component according to the present disclosure, the bottom face side extended electrode layer and the top face side extended electrode layer have extended electrodes formed on the surface of the insulation layer. The material constituting the extended electrode is not particularly limited, but may include Ag or the like. Further, a material constituting the insulator layer may include a non-magnetic material such as a glass ceramic material.

In the electronic component according to the present disclosure, the primary coil conductor layer and the bottom face side extended electrode layer are connected to each other through a via hole conductor. The secondary coil conductor layer and the bottom face side extended electrode layer are connected to each other through a via hole conductor. The tertiary coil conductor layer and the top face side extended electrode layer are connected to each other through a via hole conductor, and the parallel primary coil conductor layer and the top face side extended electrode layer are connected to each other through a via hole conductor.

The material for forming the via hole conductor is not particularly limited, but may include Ag or the like. The material constituting the external electrode is not particularly limited, but may include Ni, Sn or the like. Further, an underlying electrode may be provided inside the electrode layer made of Ni or Sn.

Examples of the underlying electrode include those obtained by applying a conductive paste containing Ag powder and glass frit on the surface of the laminated body and firing the same. By forming a Ni film or a Sn film on the surface of the underlying electrode by plating, an external electrode is formed.

Other embodiments of an electronic component according to the present disclosure will be described.

In the electronic component according to the present disclosure, each of the primary coil conductor layer, the secondary coil conductor layer, the tertiary coil conductor layer and the parallel primary coil conductor layer may have two or more coil conductors. When one coil conductor layer has two or more coil conductors, each coil conductor preferably has a coil pattern substantially overlapping each other in a top view of the laminated body. At this time, the coil conductors are connected in parallel.

In a case where the number of secondary coil conductors constituting the secondary coil conductor layer is set to be two and the number of tertiary coil conductors constituting the tertiary coil conductor layer is set to be two, when the cross-sectional areas of the respective coil conductors are set to be the same, the combined value of the series resistance in the secondary coil conductor layer and the tertiary coil conductor layer is substantially equal to the combined value of the series resistance of the primary coil conductor and the parallel primary coil conductor. In this case, the first and fourth external electrodes connected to the primary coil conductor layer and the parallel primary coil conductor layer, the second and fifth external electrodes connected to the secondary coil conductor layer having the two secondary coil conductors, and the third and sixth external electrodes connected to the tertiary coil conductor layer having the two tertiary coil conductors are substantially equivalent. Therefore, as described above, even when the first external electrode and the fourth external electrode are not disposed between the second external electrode and the third external electrode and between the fifth external electrode and the sixth external electrode, the electronic components can be used without the distinction of the left and right of the electronic components.

A case where the coil conductor layer includes a plurality of coil conductors will be described with reference to FIGS. 4 and 5.

Figure 4:
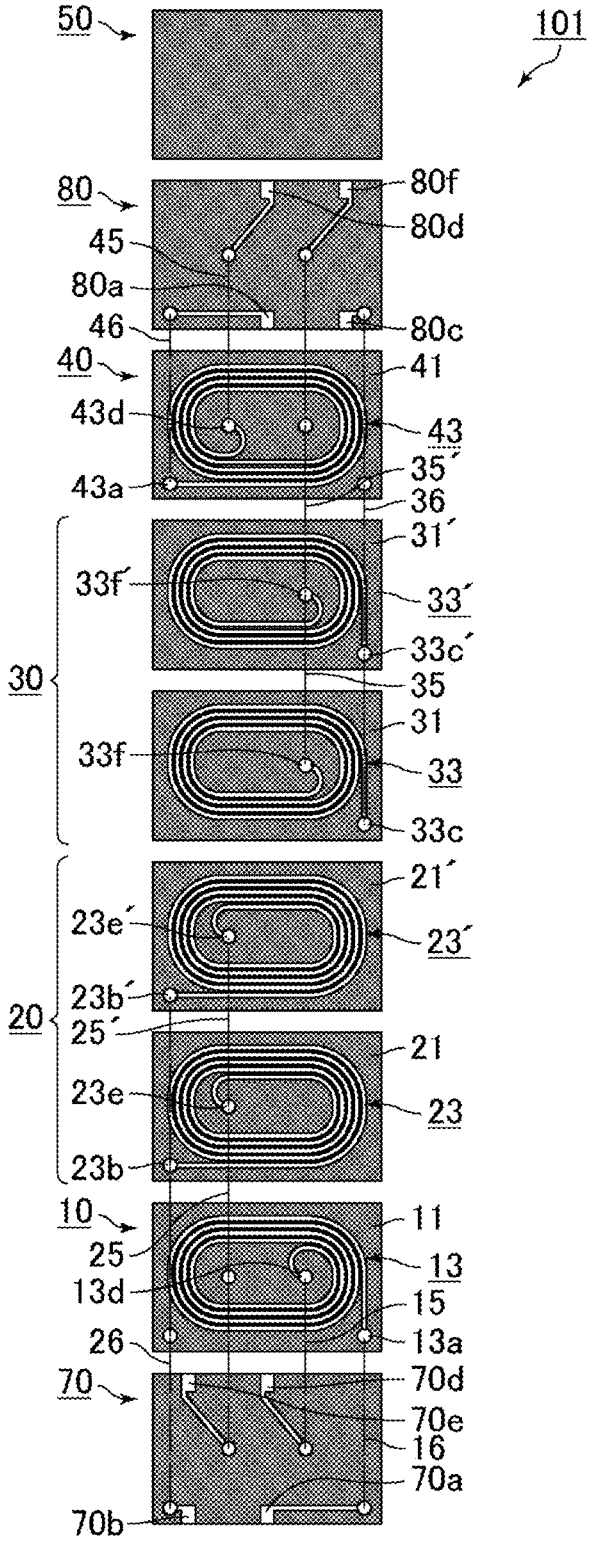
FIG. 4 is an explanatory view schematically showing a state of another example in which a laminated body constituting the electronic component according to the present disclosure is separated and arranged for each layer.
Figure 5:
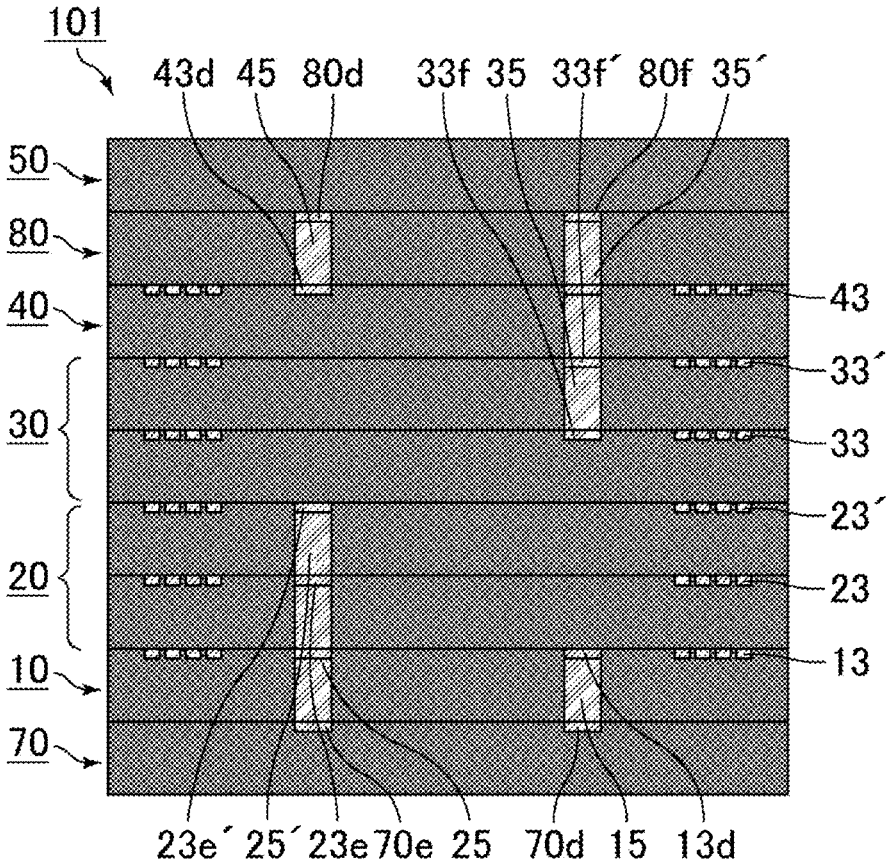
FIG. 5 is a cross-sectional view schematically showing a state in which the laminated body shown in FIG. 4 is cut at a position same as line A-A in FIG. 1.

FIG. 4 is an explanatory view schematically showing a state of another example in which a laminated body constituting the electronic component according to the present disclosure is separated and arranged for each layer. FIG. 5 is a cross-sectional view schematically showing a state in which the laminated body shown in FIG. 4 is cut at a position same as line A-A in FIG. 1. As shown in FIGS. 4 and 5, a laminated body 101 includes, in order from the bottom face, the bottom face side extended electrode layer 70, the primary coil conductor layer 10, the secondary coil conductor layer 20, the tertiary coil conductor layer 30, the parallel primary coil conductor layer 40, the top face side extended electrode layer 80, and the insulator layer 50.

The secondary coil conductor layer 20 has two secondary coil conductors (23, 23'), and the tertiary coil conductor layer 30 has two tertiary coil conductors (33, 33'). The two secondary coil conductors 23, 23' are formed on the surfaces of insulation layers 21, 21', respectively. The two tertiary coil conductors 33, 33' are formed on the surfaces of insulation layers 31, 31', respectively.

Connections between the coil conductors except for the secondary coil conductor 23' and the tertiary coil conductor 33', and the via hole conductor and the extended electrode are the same as those in the case of the laminated body 100 described in FIGS. 1 to 3. In the secondary coil conductor layer 20, the two secondary coil conductors 23, 23' substantially overlap each other in a top view of the laminated body 101.

The secondary coil conductor 23' has an outer end 23*b*' provided outside the coil pattern and an inner end 23*e*' provided inside the coil pattern, and the positions of the outer end 23*b*' and the inner end 23*e*', in the top view of the laminated body, substantially overlap the outer end 23*b* and the inner end 23*e* of the secondary coil conductor 23. Therefore, the secondary coil conductors 23, 23' are connected to the bottom face side extended electrode layer 70 through second via hole conductors 25, 25' and the via hole conductor 26.

In the tertiary coil conductor layer 30, the two tertiary coil conductors 33, 33' substantially overlap each other in a top view of the laminated body 101. The tertiary coil conductor 33' has an outer end 33*c*' provided outside the coil pattern and an inner end 33*f* provided inside the coil pattern, and the positions of the outer end 33*c*' and the inner end 33*f*, in the top view of the laminated body, substantially overlap the outer end 33*c* and the inner end 33*f* of the tertiary coil conductor 33. Therefore, the tertiary coil conductors 33, 33' are connected to the top face side extended electrode layer 80 through third via hole conductors 35, 35' and the via hole conductor 36.

The laminated body 101 includes the primary coil conductor 13, the secondary coil conductor 23, the secondary coil conductor 23', the tertiary coil conductor 33, the tertiary coil conductor 33', and the parallel primary coil conductor 43 from the bottom face side in this order. Furthermore, the primary coil conductor 13 and the parallel primary coil conductor 43 are connected in parallel, the secondary coil conductor 23 and the secondary coil conductor 23' are connected in parallel, and the tertiary coil conductor 33 and the tertiary coil conductor 33' are connected in parallel.

In such a state, the characteristic impedance between the primary coil conductor layer 10, and the parallel primary coil conductor layer 40 and the secondary coil conductor layer 20, the characteristic impedance between the secondary coil conductor layer 20 and the tertiary coil conductor layer 30, and the characteristic impedance between the tertiary coil conductor layer 30 and the primary coil conductor layer 10, and the parallel primary coil conductor layer 40 can be matched. When the characteristic impedances between the respective coil conductor layers substantially coincide with each other (match), it is possible to suppress the energy loss due to the electronic components.

In the electronic component according to the present disclosure, an inner magnetic path penetrating the primary coil conductor layer, the secondary coil conductor layer, the tertiary coil conductor layer and the parallel primary coil conductor layer may be provided at a position inside the coil pattern in each of the primary coil conductor layer, the secondary coil conductor layer, the tertiary coil conductor layer and the parallel primary coil conductor layer, the position overlapping none of the first via hole conductor, the second via hole conductor, the third via hole conductor and the fourth via hole conductor in the top view of the laminated body. When the inner magnetic path is provided inside the coil pattern, the interaction of the magnetic field generated by each coil conductor is intensified and the impedance characteristics are improved.

A laminated body having an inner magnetic path will be described with reference to FIGS. 6 and 7.

Figure 6:
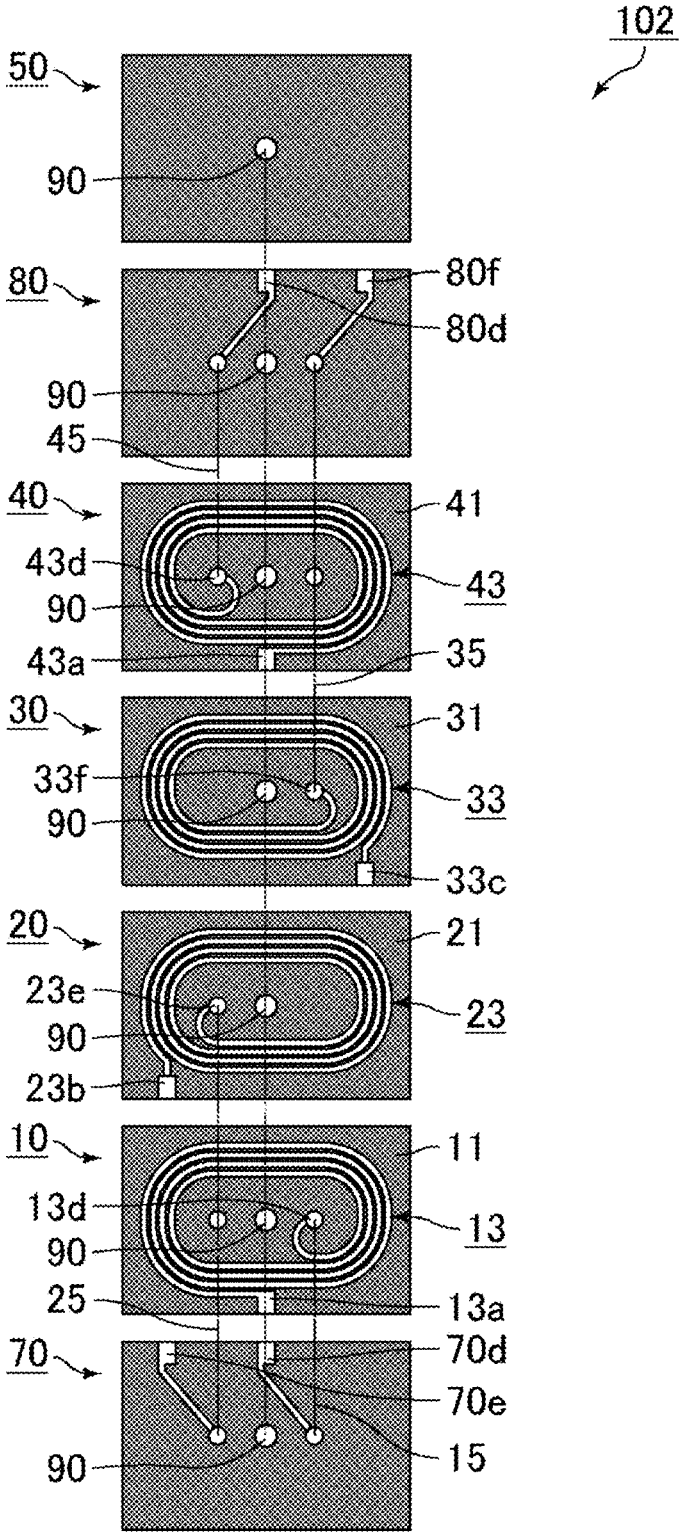
FIG. 6 is an explanatory view schematically showing a state of still another example in which a laminated body constituting the electronic component according to the present disclosure is separated and arranged for each layer.

FIG. 6 is an explanatory view schematically showing a state of still another example in which a laminated body constituting the electronic component according to the present disclosure is separated and arranged for each layer. FIG. 7 is a cross-sectional view schematically showing a state in which the laminated body shown in FIG. 6 is cut at a position same as line A-A in FIG. 1.

Figure 7:
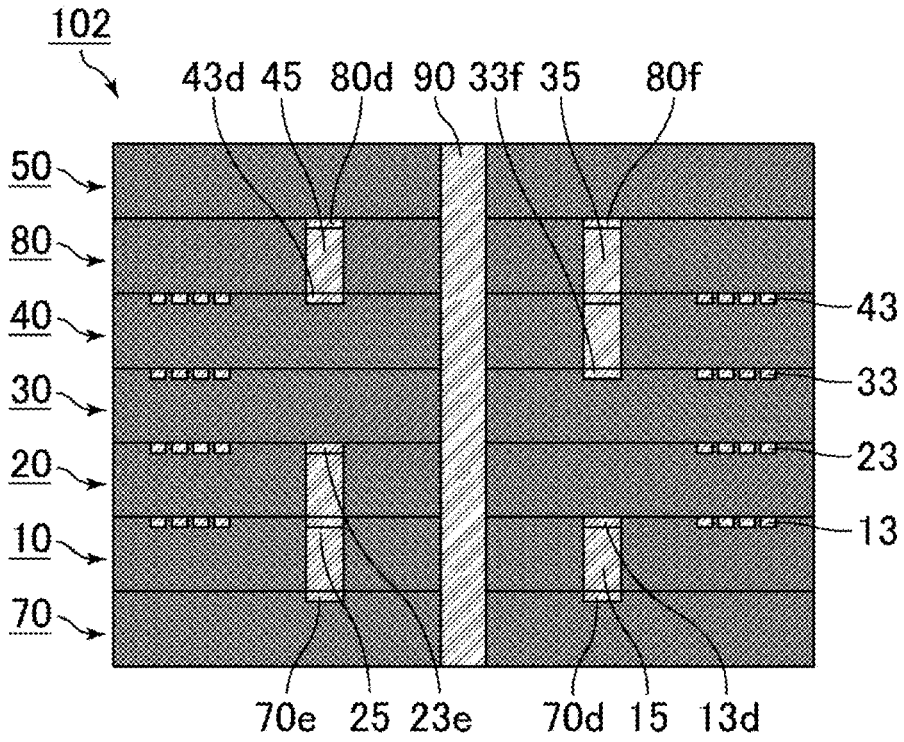
FIG. 7 is a cross-sectional view schematically showing a state in which the laminated body shown in FIG. 6 is cut at a position same as line A-A in FIG. 1.

As shown in FIGS. 6 and 7, a laminated body 102 includes, in order from the bottom face, the bottom face side extended electrode layer 70, the primary coil conductor layer 10, the secondary coil conductor layer 20, the tertiary coil conductor layer 30, the parallel primary coil conductor layer 40, the top face side extended electrode layer 80, and the insulator layer 50. As shown in FIG. 7, the laminated body 102 has an inner magnetic path 90 inside the coil pattern.

The inner magnetic path 90 penetrates the bottom face side extended electrode layer 70, the primary coil conductor layer 10, the secondary coil conductor layer 20, the tertiary coil conductor layer 30, the parallel primary coil conductor layer 40, the top face side extended electrode layer 80, and the insulator layer 50 at a position not overlapping the first via hole conductor 15, the second via hole conductor 25, the third via hole conductor 35, and the fourth via hole conductor 45 in top view. The laminated body 102 shown in FIGS. 6 and 7 differs from the laminated body 100 shown in FIGS. 1 to 3 and the laminated body 101 shown in FIGS. 4 to 5 in that the via hole conductor is not formed outside the coil pattern of each coil conductor layer.

In the primary coil conductor layer 10, the outer end 13*a* of the primary coil conductor 13 is directly exposed to the end face of the laminated body 102, and the inner end 13*d* is connected, through the first via hole conductor 15, to the extended electrode 70*d* of the bottom face side extended electrode layer 70. In the secondary coil conductor layer 20, the outer end 23*b* of the secondary coil conductor 23 is directly exposed to the end face of the laminated body 102, and the inner end 23*e* is connected, through the second via hole conductor 25, to the extended electrode 70*e* of the bottom face side extended electrode layer 70.

In the tertiary coil conductor layer 30, the outer end 33*c* of the tertiary coil conductor 33 is directly exposed to the end face of the laminated body 102, and the inner end 33*f* is connected, through the third via hole conductor 35, to the extended electrode 80*f* of the top face side extended electrode layer 80. In the parallel primary coil conductor layer 40, the outer end 43*a* of the parallel primary coil conductor 43 is directly exposed to the end face of the laminated body 102, and the inner end 43*d* is connected, through the fourth via hole conductor 45, to the extended electrode 80*d* of the top face side extended electrode layer 80.

The material constituting the inner magnetic path is not particularly limited, but it is preferable that the material having a high relative permeability be used. A material having a high relative permeability includes, for example, ferrite such as Ni—Zn—Cu ferrite.

Still another embodiment of the electronic component according to the present disclosure will be described with reference to FIGS. 8 and 9.

Figure 8:
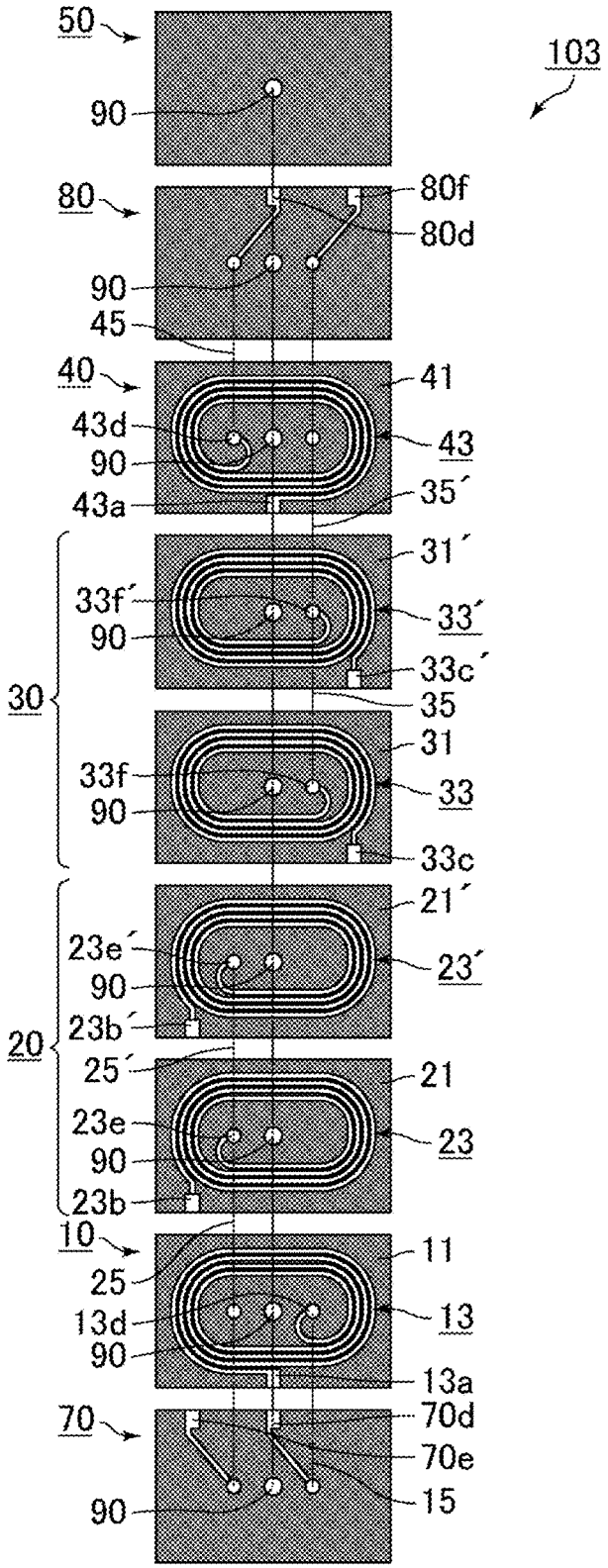
FIG. 8 is an explanatory view schematically showing a state of yet another example in which a laminated body constituting the electronic component according to the present disclosure is separated and arranged for each layer.

FIG. 8 is an explanatory view schematically showing a state of yet another example in which a laminated body constituting the electronic component according to the present disclosure is separated and arranged for each layer. FIG. 9 is a cross-sectional view schematically showing a state in which the laminated body shown in FIG. 8 is cut at a position same as line A-A in FIG. 1.

Figure 9:
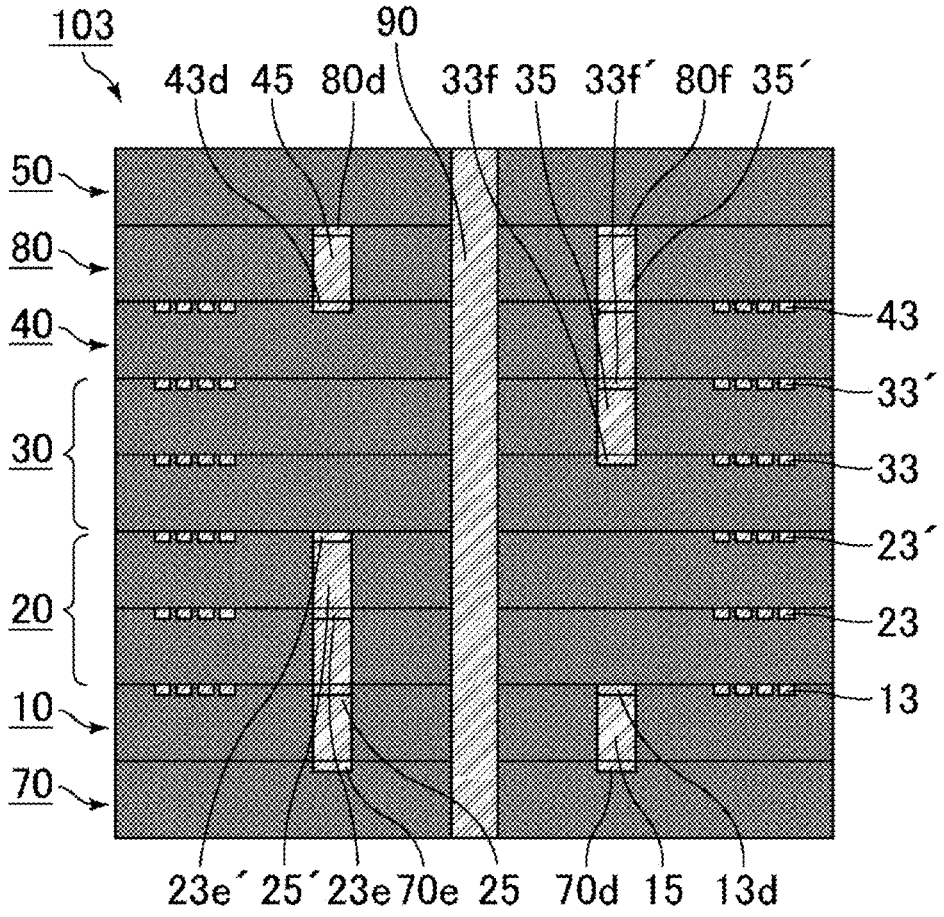
FIG. 9 is a cross-sectional view schematically showing a state in which the laminated body shown in FIG. 8 is cut at a position same as line A-A in FIG. 1.

As shown in FIGS. 8 and 9, the laminated body includes, in order from the bottom face, the bottom face side extended electrode layer 70, the primary coil conductor layer 10, the secondary coil conductor layer 20, the tertiary coil conductor layer 30, the parallel primary coil conductor layer 40, the top face side extended electrode layer 80, and the insulator layer 50. As shown in FIG. 9, a laminated body 103 has the inner magnetic path 90 inside the coil pattern.

The inner magnetic path 90 penetrates the bottom face side extended electrode layer 70, the primary coil conductor layer 10, the secondary coil conductor layer 20, the tertiary coil conductor layer 30, the parallel primary coil conductor layer 40, the top face side extended electrode layer 80, and the insulator layer 50 at a position not overlapping the first via hole conductor 15, the second via hole conductor 25, the third via hole conductor 35, and the fourth via hole conductor 45 in top view of the laminated body 103. Further, in the secondary coil conductors 23, 23' constituting the secondary coil conductor layer 20, the outer ends 23*b*, 23*b'* of the coil pattern are directly exposed to the end face of the laminated body 103, and are connected to the second external electrode 200*b*.

Also in the tertiary coil conductors 33, 33' constituting the tertiary coil conductor layer 30, the outer ends 33*c*, 33*c'* which are the outer ends of the coil pattern are directly exposed to the end face of the laminated body 103, and are connected to the third external electrode 200*c*. Connections between other via hole conductors and each coil conductor, and the extended electrode are the same as those of the laminated body 102 described in FIGS. 6 to 7.

In the electronic component according to the present disclosure, it is preferable that a bottom face side magnetic layer and a top face side magnetic layer, which are magnetic layers containing at least ferrite, be provided on the bottom of the bottom face side extended electrode layer, and the top of the top face side extended electrode layer, respectively.

Providing the bottom face side magnetic layer and the top face side magnetic layer can improve the impedance characteristics.

In a case where the laminated body has an inner magnetic path, the inner magnetic path, and the bottom face side magnetic layer and the top face side magnetic layer may be made of the same material. In this case, at the stage of preparing the laminated body, a region in which the inner magnetic path is formed is prepared as a void (through hole), and after preparing the laminated body, using a method of filling the void (through hole) with magnetic paste which is a raw material of the magnetic layer, the inner magnetic path and the magnetic layer may be simultaneously formed.

When an insulator layer is provided on the top of the top face side extended electrode layer, it is preferable that the top face side magnetic layer be provided on the top of the insulator layer. Further, in a case where the insulator layer is provided on the bottom of the bottom face side extended electrode layer, the bottom face side magnetic layer is preferably provided on the bottom of the insulator layer.

An electronic component provided with a magnetic layer will be described with reference to FIG. 10.

Figure 10:
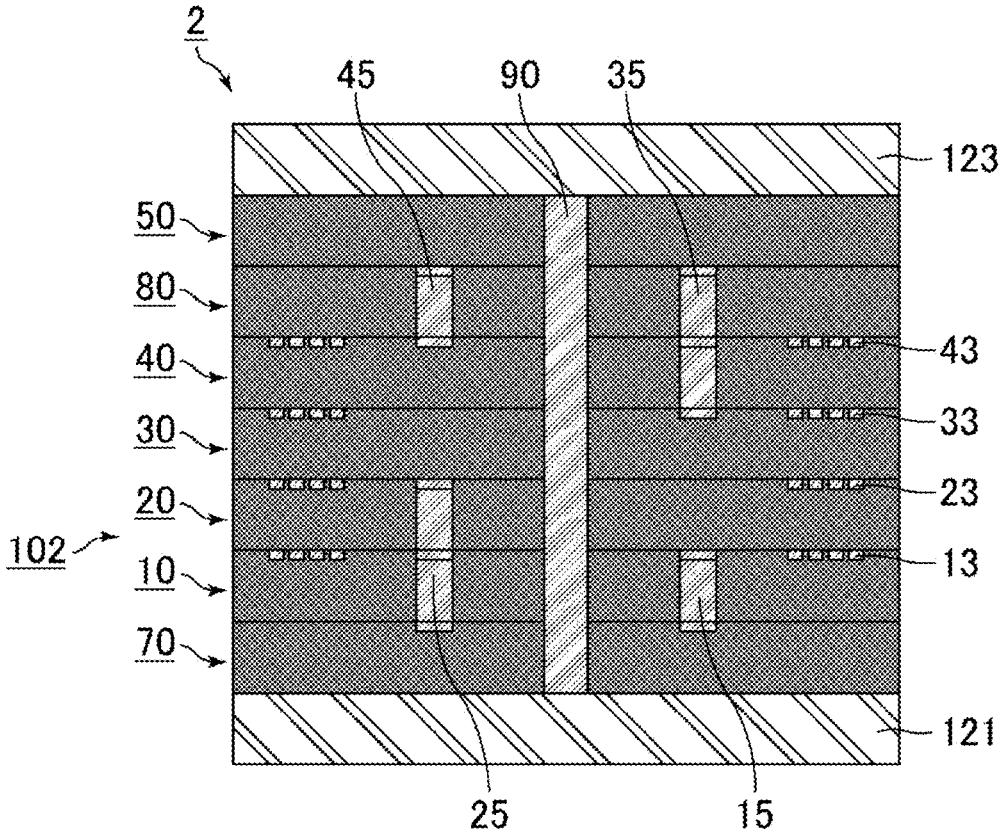
FIG. 10 is a cross-sectional view schematically showing another example of the electronic component according to the present disclosure.

FIG. 10 is a cross-sectional view schematically showing another example of an electronic component according to the present disclosure. As shown in FIG. 10, in an electronic component 2, a bottom face side magnetic layer 121 and a top face side magnetic layer 123 are provided on the bottom and the top of the laminated body 102, respectively.

In FIG. 10, the configurations of the bottom face side magnetic layer 121 and the top face side magnetic layer 123 are described as completely different from that of the inner magnetic path 90. However, the inner magnetic path 90, and the bottom face side magnetic layer 121 and the top face side magnetic layer 123 may be made of the same material and integrally molded.

In the electronic component according to the present disclosure, a bottom face side insulator layer and a top face side insulator layer, which are insulator layers containing at least glass ceramic, may be provided on the bottom and on the top of the laminated body. It is preferable that the bottom face side insulator layer be provided on the bottom of the bottom face side magnetic layer and the top face side insulator layer be provided on the top of the top face side magnetic layer.

In the case of providing a magnetic layer on the surface of the laminated body, a magnetic sheet to be a magnetic layer is laminated on the top face and the bottom face of the laminated body of the ceramic green sheets and fired. At this time, the ceramic green sheet serving as the insulation layer cannot follow a dimensional change due to the firing of the magnetic sheet, and cracks may occur in the obtained laminated body. Here, when an insulator sheet to be an insulator layer is further laminated on the top and bottom faces of the magnetic sheet, the dimensional change during the firing of the magnetic sheet sandwiched between the insulator sheets is suppressed, and it is possible to suppress cracks from generating in the laminated body.

An electronic component provided with an insulator layer will be described with reference to FIG. 11.

Figure 11:
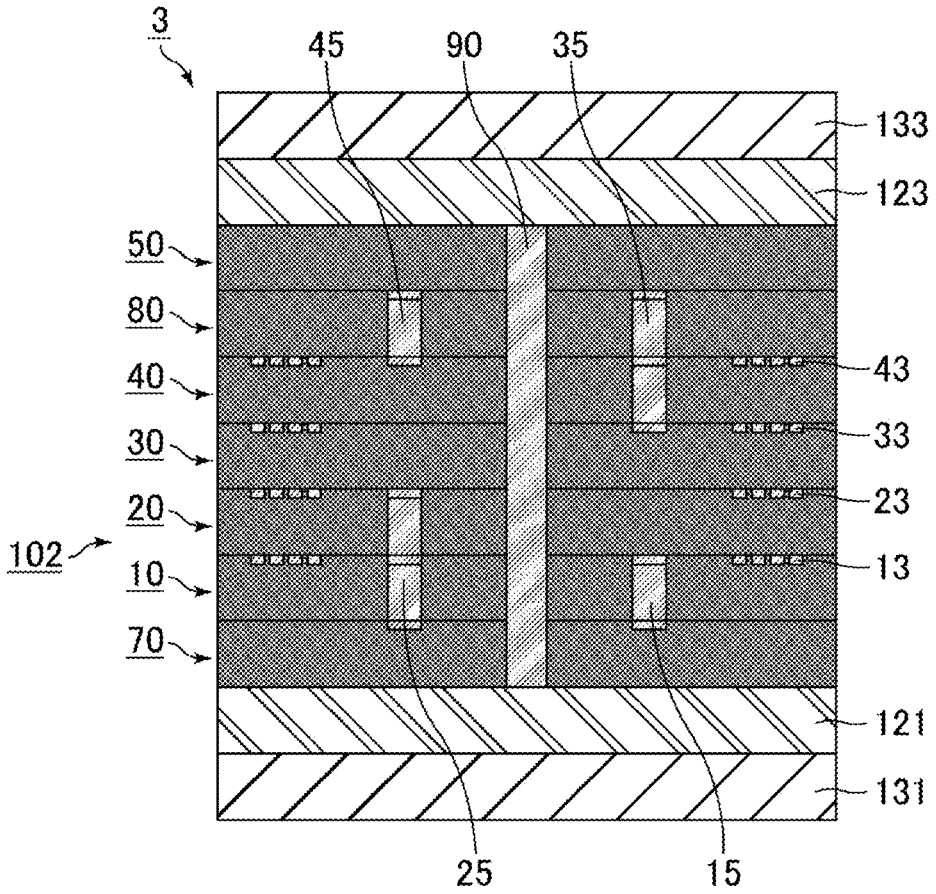
FIG. 11 is a cross-sectional view schematically showing still another example of the electronic component according to the present disclosure.

FIG. 11 is a cross-sectional view schematically showing still another example of an electronic component according to the present disclosure. As shown in FIG. 11, in an electronic component 3, the bottom face side magnetic layer 121 and the top face side magnetic layer 123 are provided on the bottom and the top of the laminated body 102, respectively. A bottom face side insulator layer 131 is further provided on the bottom of the bottom face side magnetic layer 121, and a top face side insulator layer 133 is further provided on the top of the top face side magnetic layer 123. The magnetic layer may be further provided on the bottom of the bottom face side insulator layer and on the top of the top face side insulator layer.

When a magnetic layer is further provided on the bottom and the top of the insulator layer, magnetic leakage from the electronic component can be suppressed. In this case, the bottom face side magnetic layer, the bottom face side insulator layer, the bottom face side magnetic layer, the laminated body, the top face side magnetic layer, the top face side insulator layer and the top face side magnetic layer are laminated in this order from the bottom face.

Still another embodiment of an electronic component according to the present disclosure will be described.

In the electronic component according to the present disclosure, each of the secondary coil conductor and the tertiary coil conductor may have two or more coil conductors. Each of the coil conductors constituting the secondary coil conductor and the tertiary coil conductor preferably has a coil pattern substantially overlapping each other in a top view of the laminated body. At this time, the coil conductors are connected in parallel.

In the electronic component according to the present disclosure, when the inner magnetic path is not provided inside the coil pattern, a space for securing the inner magnetic path can be used for increasing the number of windings of the coil pattern. Examples of such cases are shown in FIGS. 12 and 13.

Figure 12:
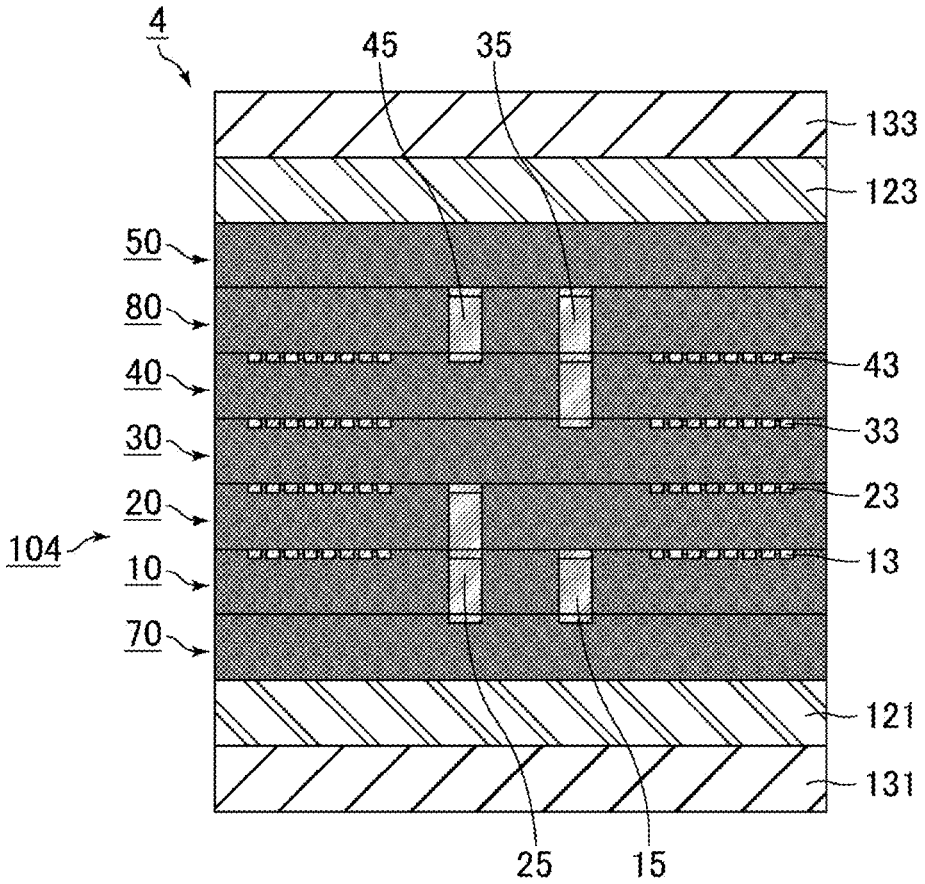
FIG. 12 is a cross-sectional view schematically showing yet another example of the electronic component according to the present disclosure.
Figure 13:
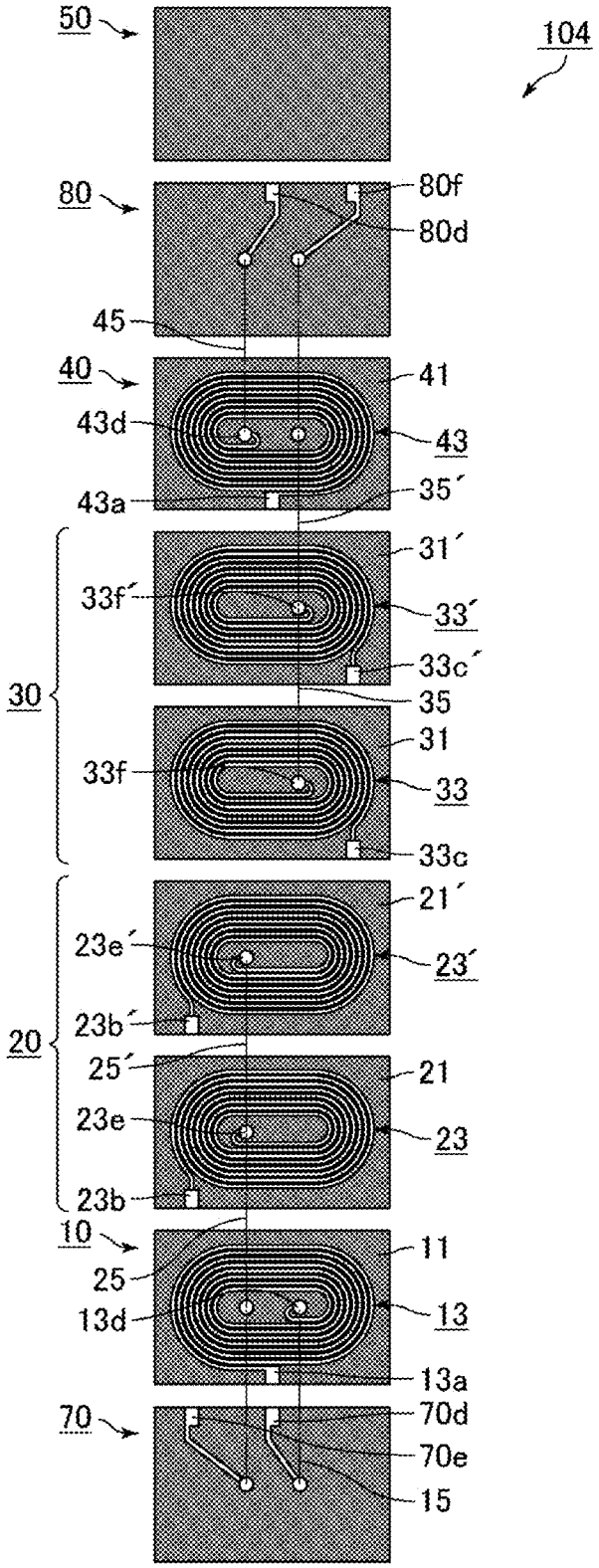
FIG. 13 is a cross-sectional view schematically showing a state in which the laminated body constituting the electronic component shown in FIG. 12 is separated and arranged for each layer.

FIG. 12 is a cross-sectional view schematically showing yet another example of an electronic component according to the present disclosure, and FIG. 13 is a cross-sectional view schematically showing a state where the laminated body constituting the electronic component shown in FIG. 12 is separated and arranged for each layer.

In an electronic component 4 shown in FIG. 12, the bottom face side magnetic layer 121 and the top face side magnetic layer 123 are provided on the bottom face and the top face of a laminated body 104, respectively. The bottom face side insulator layer 131 is further provided on the bottom of the bottom face side magnetic layer 121, and the top face side insulator layer 133 is further provided on the top of the top face side magnetic layer 123.

As shown in FIG. 13, the laminated body 104 includes, in order from the bottom face, the bottom face side extended electrode layer 70, the primary coil conductor layer 10, the secondary coil conductor layer 20, the tertiary coil conductor layer 30, the parallel primary coil conductor layer 40, the top face side extended electrode layer 80, and the insulator layer 50.

In the laminated body 104, instead of providing the inner magnetic path, the number of windings of the coil pattern is increased from that of the laminated body 103 shown in FIG. 8. That is, the number of windings of the coil pattern of the primary coil conductor 13 constituting the primary coil conductor layer 10, the secondary coil conductors 23, 23' constituting the secondary coil conductor layer 20, the tertiary coil conductor 33, 33' constituting the tertiary coil conductor layer 30, and the parallel primary coil conductor 43 constituting the parallel primary coil conductor layer 40 is eight.

Connections between other via hole conductors and each coil conductor, and the extended electrode are the same as those of the laminated body 103 described in FIG. 9.

[Method of Manufacturing Electronic Component]

Next, a method of manufacturing an electronic component according to the present disclosure will be described.

First, a ceramic green sheet to be an insulation layer is prepared. For example, an organic binder such as polyvinyl butyral type, organic solvents such as ethanol and toluene, a dispersant, and the like are added to a non-magnetic material such as a glass ceramic material, or a mixed material obtained by mixing a non-magnetic material with a magnetic material such as a ferrite material, and kneaded to form a slurry. Thereafter, a ceramic green sheet is obtained by a method such as a doctor blade method. An insulation layer is obtained by firing this ceramic green sheet.

As the glass ceramic material, it is preferable to use borosilicate glass containing Si and B as a main component. As a composition of the borosilicate glass, for example, $SiO_2$ is 70 wt % or more and 85 wt % or less (i.e., from 70 wt % to 85 wt %), $B_2O_3$ is 10 wt % or more and 25 wt % or less (i.e., from 10 wt % to 25 wt %), $K_2O$ is 0.5 wt % or more and 5 wt % or less (i.e., from 0.5 wt % to 5 wt %), and $Al_2O_3$ is 0 wt % or more and 5 wt % or less (i.e., from 0 wt % to 5 wt %). Since borosilicate glass has a low relative permittivity, high frequency characteristics of electronic components can be improved.

In addition to the ferrite material and the glass ceramic material, a filler component such as quartz ($SiO_2$), forsterite ($2MgO.SiO_2$), alumina ($Al_2O_3$) or the like may be further added. The amount of the filler component to be added is preferably 2 wt % or more and 41 wt % or less (i.e., from 2 wt % to 41 wt %), more preferably 34.5 wt % or more and 41 wt % or less (i.e., from 34.5 wt % to 41 wt %), of the entire ceramic green sheet. In particular, the amount of quartz to be added is preferably 34 wt % or more and 37 wt % or less (i.e., from 34 wt % to 37 wt %) of the entire ceramic green sheet, and the amount of alumina to be added is preferably 0.5 wt % or more and 4 wt % or less (i.e., from 0.5 wt % to 4 wt %) of the entire ceramic green sheet.

Quartz has a relative permittivity lower than that of borosilicate glass and can further improve the high frequency characteristics. Forsterite and alumina have high transverse rupture strength and can improve mechanical strength.

As a ferrite material, for example, oxide raw materials of iron, nickel, zinc and copper are mixed and calcined at 800° C. for 1 hour, then pulverized by a pole mill and dried to obtain a Ni—Zn—Cu ferrite raw material (oxide mixed powder) having an average particle diameter of about 0.5 μm. When a ceramic green sheet using a ferrite material is prepared, in order to obtain a high L value (inductance), it is preferable to use a ferrite material composed of $Fe_2O_3$: 40 mol % or more and 49.5 mol % or less (i.e., from 40 mol % to 49.5 mol %), ZnO: 5 mol % or more and 35 mol % or less (i.e., from 5 mol % to 35 mol %), CuO: 4 mol % or more and 12 mol % or less (i.e., from 4 mol % to 12 mol %), and the remnant: NiO and a minor additive (including inevitable impurities).

The prepared ceramic green sheet is subjected to predetermined laser processing to form a via hole having a diameter of about 30 μm or more and about 40 μm or less (i.e., from 30 μm to 40 μm). Ag paste is filled in the via hole, and a coil conductor pattern (coil conductor) having a thickness of about 11 μm is screen-printed and dried to obtain a coil sheet to be a coil conductor layer by firing. Further, the prepared ceramic green sheet is subjected to laser processing as necessary to form a via hole, an extended electrode pattern having a thickness of about 11 μm is screen-printed and dried to obtain an electrode sheet to be an extended electrode layer by firing.

Note that an insulator layer is formed by firing a ceramic green sheet on which the coil conductor pattern and the extended electrode pattern (also collectively referred to as a pattern) are not printed.

Thereafter, a bottom face electrode sheet to be the bottom face side extended electrode layer, a primary coil sheet to be the primary coil conductor layer, a secondary coil sheet to be the secondary coil conductor layer, a tertiary coil sheet to be the tertiary coil conductor layer, a parallel primary coil sheet to be the parallel primary coil conductor layer, a top face electrode sheet to be the top face side extended electrode layer, and a ceramic green sheet not having a pattern printed thereon are laminated in this order and thermo-bonded to obtain a laminated sheet.

At this time, respective coil sheets and electrode sheets are laminated such that the coil patterns of the primary coil conductor, the secondary coil conductor, the tertiary coil conductor and the parallel primary coil conductor substantially overlap each other in the top view, corresponding via holes overlap among the via holes formed in each coil sheet in top view, and the positions of the via holes and the extended electrodes are aligned The obtained laminated sheet is cut into a predetermined size to obtain a laminated body precursor to be a laminated body by firing.

In the case of providing the inner magnetic path in the laminated body, a method may be used in which sandblasting is performed at a predetermined position of the laminated sheet to form via holes and the inner magnetic path paste to be an inner magnetic path by firing is batch-filled. A method may be used in which in preparing the coil sheet, the inner magnetic path paste is sequentially filled into via holes formed by applying laser processing to the ceramic green sheet.

The inner magnetic path paste is obtained by adding, for example, an organic binder such as polyvinyl butyral type, organic solvents such as ethanol and toluene, and a dispersant to a Ni—Zn—Cu ferrite raw material, and kneading them.

Thereafter, binder removal and firing are performed at a predetermined temperature and time, whereby the bottom face side extended electrode layer, the primary coil conductor layer, the secondary coil conductor layer, the tertiary coil conductor layer, the parallel primary coil conductor layer, the top face side extended electrode layer, and the insulator layer are laminated in this order to obtain a fired body (laminated body).

As a binder removal condition, there is a method of heating to a temperature of 350 to 500° C. in an air atmosphere. As a firing condition, there is a method of heating to a temperature of 850 to 920° C. in an air atmosphere.

It is preferable to perform barrel polishing in which the laminated body obtained by the firing and an abrasive are contained in a barrel and the corner portion and the ridgeline portion of the laminated body are rounded by imparting rotational motion to the barrel.

The burr formed on the cut surface of the laminated body is removed by barrel polishing, and the corner portion and the ridgeline portion of the laminated body can be rounded to increase the mechanical strength.

When it is desired to additionally provide a magnetic layer or an insulator layer on the surface of the laminated body, in obtaining the laminated body precursor, a green sheet to be a magnetic layer or a green sheet to be an insulator layer may be laminated on both surfaces of the bottom face electrode sheet and the top face electrode sheet and thermo-bonded.

By forming external electrodes at the predetermined position of the obtained laminated body, the electronic component according to the present disclosure can be obtained.

As a method of forming the external electrode on the surface of the laminated body, for example, three underlying electrodes are formed on each of the first end face and the second end face among the surfaces of the laminated body, and a plating electrode is formed so as to cover the surface of the underlying electrode.

As a method of forming the underlying electrode, for example, an underlying electrode paste containing a mixture of Ag powder and a predetermined amount of glass frit is applied to the surface of the laminated body, and is fired and baked at a temperature of about 900° C.

Ni film and Sn film of a predetermined thickness are sequentially formed on the underlying electrode by plating to form external electrodes.

Thus, the electronic component according to the present disclosure can be produced.

The electronic component according to the present disclosure can be suitably used, for example, for a common mode choke coil, an inductor element, an LC composite part, and the like.

What is claimed is:

1. An electronic component with a plurality of coil conductor layers laminated wherein a coil conductor having a coil pattern on a surface of an insulation layer is formed on each of the plurality of coil conductor layers, the electronic component comprising:

a laminated body in which a bottom face side extended electrode layer, a primary coil conductor layer including a primary coil conductor, a secondary coil conductor layer including a secondary coil conductor, a tertiary coil conductor layer including a tertiary coil conductor, a parallel primary coil conductor layer including a parallel primary coil conductor, and a top face side extended electrode layer are laminated in this order; and a first external electrode; a second external electrode; a third external electrode; a fourth external electrode; a fifth external electrode; and a sixth external electrode, wherein all of the external electrodes are provided on a surface of the laminated body, wherein the primary coil conductor is connected to the first external electrode and the fourth external electrode, the secondary coil conductor is connected to the second external electrode and the fifth external electrode, the tertiary coil conductor is connected to the third external electrode and the sixth external electrode, the parallel primary coil conductor is connected to the first external electrode and the fourth external electrode, the primary coil conductor and the parallel primary coil conductor are connected in parallel, each of the primary coil conductor, the secondary coil conductor, the tertiary coil conductor and the parallel primary coil conductor has a coil pattern, an inner end which is one end of the coil pattern and is disposed inside the coil pattern, and an outer end which is the other end of the coil pattern and is disposed outside the coil pattern, the inner end of the primary coil conductor and the inner end of the secondary coil conductor are connected to the bottom face side extended electrode layer through a first via hole conductor and a second via hole conductor both of which are provided inside the coil pattern, respectively, the inner end of the tertiary coil conductor and the inner end of the parallel primary coil conductor are connected to the top face side extended electrode layer through a third via hole conductor and a fourth via hole conductor both of which are provided inside the coil pattern, respectively, in a top view of the laminated body, the first via hole conductor and the second via hole conductor are disposed at a position to overlap any one of the third via hole conductor and the fourth via hole conductor, and a number of via hole conductors provided inside the coil pattern is two at a maximum in each of all coil conductor layers constituting the laminated body.

2. The electronic component according to claim 1, wherein the first external electrode, the second external electrode, and the third external electrode are provided on a first end face of the laminated body, the fourth external electrode, the fifth external electrode, and the sixth external electrode are provided on a second end face facing the first end face, the first external electrode, the second external electrode, and the third external electrode are disposed at positions facing the fourth external electrode, the fifth external electrode, and the sixth external electrode, respectively, the first external electrode is disposed between the second external electrode and the third external electrode, and the fourth external electrode is disposed between the fifth external electrode and the sixth external electrode.

3. The electronic component according to claim 2, wherein an inner magnetic path penetrating the primary coil conductor layer, the secondary coil conductor layer, the tertiary coil conductor layer, and the parallel primary coil conductor layer is provided at a position inside of a coil pattern in each of the primary coil conductor layer, the secondary coil conductor layer, the tertiary coil conductor layer, and the parallel primary coil conductor layer, and the position overlaps none of the first via hole conductor, the second via hole conductor, the third via hole conductor, and the fourth via hole conductor in a top view of the laminated body.

4. The electronic component according to claim 2, wherein the secondary coil conductor layer includes a plurality of secondary coil conductors having coil patterns substantially overlapping each other in the top view of the laminated body.

5. The electronic component according to claim 2, wherein the tertiary coil conductor layer includes a plurality of tertiary coil conductors having coil patterns substantially overlapping each other in the top view of the laminated body.

6. The electronic component according to claim 2, wherein a bottom face side magnetic layer and a top face side magnetic layer which are magnetic layers containing at least ferrite are further provided on a bottom of the bottom face side extended electrode layer, and a top of the top face side extended electrode layer, respectively.

7. The electronic component according to claim 2, wherein a number of windings of a coil pattern in each of the primary coil conductor layer, the secondary coil conductor layer, the tertiary coil conductor layer, and the parallel primary coil conductor layer is four or more.

8. The electronic component according to claim 2, wherein a pitch of a coil pattern in each of the primary coil conductor layer, the secondary coil conductor layer, the tertiary coil conductor layer, and the parallel primary coil conductor layer is from 28μ to 34 μm.

9. The electronic component according to claim 2, wherein the laminated body has an outer dimension of from 0.80 mm to 1.00 mm in length, from 0.58 mm to 0.78 mm in width, and from 0.25 mm to 0.45 mm in height.

10. The electronic component according to claim 1, wherein an inner magnetic path penetrating the primary coil conductor layer, the secondary coil conductor layer, the tertiary coil conductor layer, and the parallel primary coil conductor layer is provided at a position inside of a coil pattern in each of the primary coil conductor layer, the secondary coil conductor layer, the tertiary coil conductor layer, and the parallel primary coil conductor layer, and the position overlaps none of the first via hole conductor, the second via hole conductor, the third via hole conductor, and the fourth via hole conductor in a top view of the laminated body.

11. The electronic component according to claim 10, wherein the secondary coil conductor layer includes a plurality of secondary coil conductors having coil patterns substantially overlapping each other in the top view of the laminated body.

12. The electronic component according to claim 10, wherein the tertiary coil conductor layer includes a plurality of tertiary coil conductors having coil patterns substantially overlapping each other in the top view of the laminated body.

13. The electronic component according to claim 10, wherein a bottom face side magnetic layer and a top face side magnetic layer which are magnetic layers containing at least ferrite are further provided on a bottom of the bottom face side extended electrode layer, and a top of the top face side extended electrode layer, respectively.

14. The electronic component according to claim 1, wherein the secondary coil conductor layer includes a plurality of secondary coil conductors having coil patterns substantially overlapping each other in the top view of the laminated body.

15. The electronic component according to claim 1, wherein the tertiary coil conductor layer includes a plurality of tertiary coil conductors having coil patterns substantially overlapping each other in the top view of the laminated body.

16. The electronic component according to claim 1, wherein a bottom face side magnetic layer and a top face side magnetic layer which are magnetic layers containing at least ferrite are further provided on a bottom of the bottom face side extended electrode layer, and a top of the top face side extended electrode layer, respectively.

17. The electronic component according to claim 16, wherein a bottom face side insulator layer and a top face side insulator layer which are insulator layers containing at least glass ceramic are further provided on a bottom of the bottom face side magnetic layer and a top of the top face side magnetic layer.

18. The electronic component according to claim 1, wherein a number of windings of a coil pattern in each of the primary coil conductor layer, the secondary coil conductor layer, the tertiary coil conductor layer, and the parallel primary coil conductor layer is four or more.

19. The electronic component according to claim 1, wherein a pitch of a coil pattern in each of the primary coil conductor layer, the secondary coil conductor layer, the tertiary coil conductor layer, and the parallel primary coil conductor layer is from 28 μm to 34 μm.

20. The electronic component according to claim 1, wherein the laminated body has an outer dimension of from 0.80 mm to 1.00 mm in length, from 0.58 mm to 0.78 mm in width, and from 0.25 mm to 0.45 mm in height.

* * * * *